US005825333A

United States Patent [19]

Kudoh et al.

[11] Patent Number: 5,825,333

[45] Date of Patent: Oct. 20, 1998

[54] OFFSET MULTIBEAM ANTENNA

[75] Inventors: Hiroshi Kudoh, Saitama; Kenichi Tohya, Tokyo; Masanobu Urabe, Saitama, all of Japan

[73] Assignee: Honda Giken Kogyo Kabushiki Kaisha, Tokyo, Japan

[21] Appl. No.: 967,228

[22] Filed: Oct. 29, 1997

Related U.S. Application Data

[63] Continuation of Ser. No. 701,002, Aug. 21, 1996, abandoned, which is a continuation of Ser. No. 424,588, Apr. 17, 1995, abandoned, which is a continuation of Ser. No. 26,501, Mar. 4, 1993, abandoned.

[30] Foreign Application Priority Data

Mar. 5, 1992 [JP] Japan ..... 4-097529

[51] Int. Cl.[6] ..... H01Q 19/17

[52] U.S. Cl. ..... 343/781 R; 343/767; 343/853

[58] Field of Search ..... 343/781 R, 767, 343/725, 795, 853; H01Q 19/17, 13/08, 1/38, 13/00

[56] References Cited

U.S. PATENT DOCUMENTS

| | | | |
|---|---|---|---|
| 2,691,731 | 10/1954 | Miller | 343/781 R |
| 3,448,822 | 6/1969 | La Lone et al. | 343/711 |
| 3,836,976 | 9/1974 | Monser et al. | 343/797 |
| 4,425,549 | 1/1984 | Schwartz et al. | 333/247 |
| 5,202,700 | 4/1993 | Miller | 343/840 |
| 5,227,808 | 7/1993 | Davis | 343/767 |
| 5,264,860 | 11/1993 | Quan | 343/767 |

FOREIGN PATENT DOCUMENTS

| | | |
|---|---|---|
| 57-24968 | 5/1982 | Japan . |
| 1-126714 | 8/1989 | Japan . |

*Primary Examiner*—Michael C. Wimer
*Attorney, Agent, or Firm*—Lyon & Lyon LLP

[57] ABSTRACT

An antenna device has a plurality of radar modules having respective integrated circuit boards of transmitter and receiver circuits for transmitting and receiving electromagnetic waves and a common case or respective case members accommodating the integrated circuit boards. The common case or case members have respective primary radiators integrally formed therein. The primary radiators are positioned at the focal point of an offset reflector which is fixedly supported by a holder 10 that also supports the radar modules.

6 Claims, 9 Drawing Sheets

OFFSET MULTIBEAM ANTENNA

This is a continuation of application Ser. No. 08/701,002, filed on Aug. 21, 1996, abandoned; which is a continuation of Ser. No. 08/424,588, filed on Apr. 17, 1995, abandoned; which is a continuation of Ser. No. 08/026,501, filed Mar. 4, 1993 abandoned, and which designated the U.S.

BACKGROUND OF THE INVENTION

1. Field of the Invention

The present invention relates to an offset multibeam antenna device comprising radar module boards each having an integrated circuit board of transmitter and receiver circuits, an array of horn-type primary radiators, and a reflector.

2. Description of the Prior Art

Antenna devices have an integrated circuit board, a horn-type primary radiator combined with a reflector, and a coupling circuit such as a waveguide or a coaxial cable interconnecting the integrated circuit board and the horn-type primary radiator. Since the coupling circuit is included and it requires a certain level of mechanical strength, the antenna device is relatively complex in structure and large in size. Another problem is power loss caused by the coupling circuit.

According to one known antenna device proposed in Japanese patent publication No. 57-24968, a primary radiator is integrally formed with a case of an integrated circuit board, and the integrated circuit board and the primary radiator are interconnected by a strip transmission line.

However, the above publication fails to disclose any specific structure that would be employed to apply transmitting and receiving radar modules to a multibeam antenna.

Japanese laid-open utility model publication No. 1-126714 discloses an offset multibeam antenna with an amplification capability for radiating or receiving radio waves. The disclosed offset multibeam antenna is designed for satellite communications, but not as a radar antenna for horizontally scanning objects to detect obstacles. Therefore, the disclosed offset multibeam antenna is not suitable for use with a radar system.

U.S. Pat. No. 4,349,827 discloses a radio-frequency parabolic antenna with an array of horn feeds.

SUMMARY OF THE INVENTION

It is an object of the present invention to provide a small-size, lightweight offset multibeam antenna device which has a primary radiator disposed in a case for integrated circuit boards of radar modules including transmitter and receiver circuits, the primary radiator being positioned at the focal point of an offset beam reflector for horizontally scanning a beam in a time-division multiplexing manner.

According to the present invention, there is provided an antenna device comprising a plurality of radar modules each capable of transmitting and receiving electromagnetic waves, a plurality of primary radiators integral with respective radar modules, an offset reflector, and a holder fixing the radar modules and the offset reflector to each other. Each of the radar modules comprises an Integrated circuit board of transmitter and receiver circuits and a microstrip transmission line connected to the transmitter and receiver circuits. The antenna device further comprises a plurality of fin-line converters for converting a propagation mode of electromagnetic waves from a waveguide mode in the respective primary radiators to a microstrip transmission line mode in the respective microstrip transmission lines.

The radar modules, the primary radiators, and the reflector are of an integral structure which is relatively small in size. Since the primary reflectors are securely positioned at the focal point of the offset reflector by the holder, the radiation pattern of the antenna device is prevented from being varied. The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

FIGS. 1 through 4 show the principles of the present invention by which an integrated circuit board of transmitter and receiver circuits can be oriented at any angle with respect to a primary radiator, using a fin-line converter.

Figure 1:
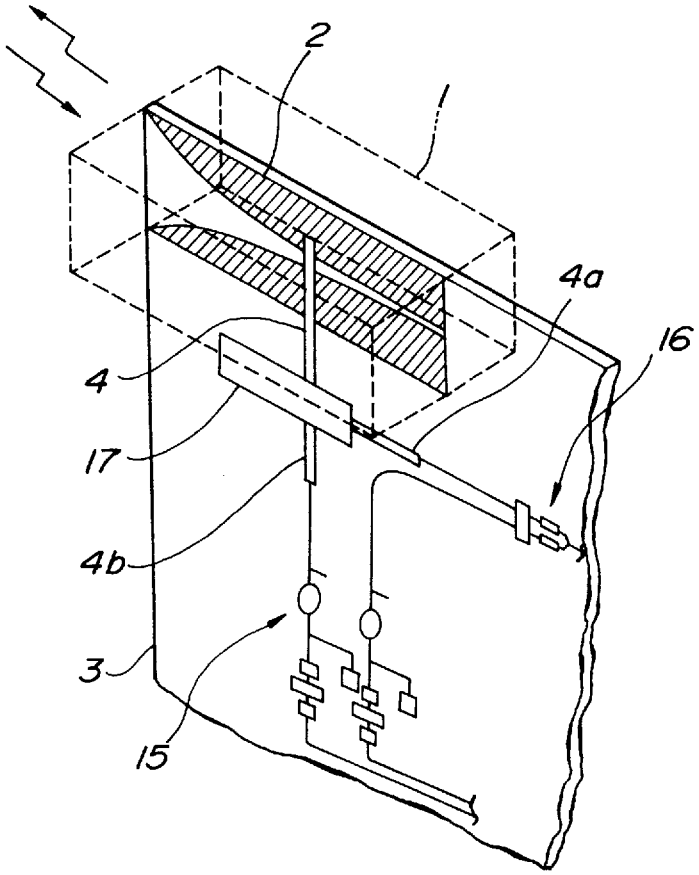
FIG. 1 is a perspective view of a primary radiator with a fin-line converter connected, by a microstrip transmission line, to and integral with an integrated circuit board of transmitter and receiver circuits.

FIG. 1 illustrates a horn-type primary radiator combined with a fin-line converter 2 positioned therein for converting the propagation mode of electromagnetic waves from a waveguide mode to a microstrip transmission line mode. The fin-line converter 2 is connected to transmitter and receiver circuits 15, 16 by a microstrip transmission line 4 on an integrated circuit board 3. In the illustrated embodiment, the microstrip transmission line 4 extends over the integrated circuit board 3 to provide a transmitter circuit 15, a receiver circuit 16 and a circulator 17 on and along the microstrip transmission line 4. The circulator 17 connects the fin-line converter 2 selectively to the receiver through a part 4*a* of the microstrip transmission line 4 and to the transmitter circuit 15 through a part 4*b* of the microstrip transmission line 4. The fin-line converter 2 and the integrated circuit board 3 are integral with each other. Specifically, the fin-line converter 2 and the integrated circuit board 3 are aligned with each other and lie flush with each other. The fin-line converter 2 converts the propagation mode from a waveguide mode in the primary radiator to a microstrip transmission line mode in the microstrip transmission line 4.

Figure 2:
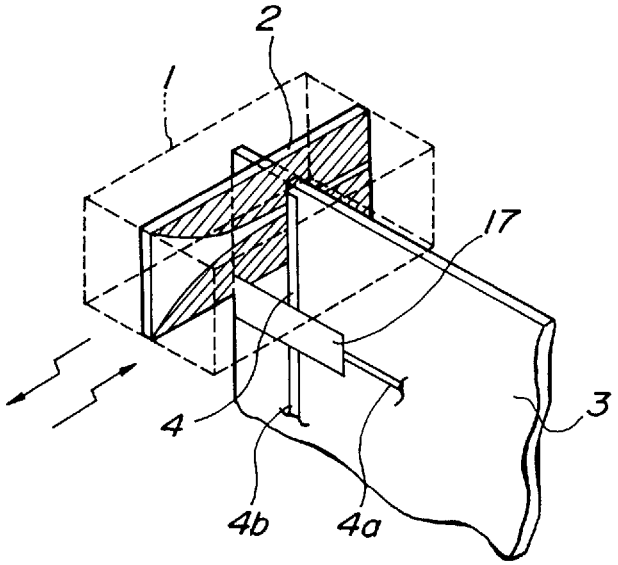
FIG. 2 is a perspective view of a primary radiator with a fin-line converter connected, by a microstrip transmission line, to an integrated circuit board of transmitter and receiver circuits which is partly inserted in a slot defined in the fin-line converter.
Figure 3:
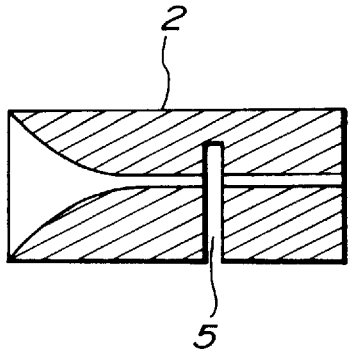
FIG. 3 is a front elevational view of the fin-line converter with the slot.

FIG. 2 illustrates a horn-type primary radiator 1 combined with a fin-line converter 2 positioned therein for converting the propagation mode of electromagnetic waves from a waveguide mode to a microstrip transmission line mode. The fin-line converter 2 is connected to transmitter and receiver circuits by a microstrip transmission line 4 on an integrated circuit board 3. Specifically, the fin-line converter 2 is not integral with the integrated circuit board 3, but has a slot 5 (see FIG. 3) defined transversely therein. The integrated circuit board 3 has an end portion on which a part of the micro transmission line 4 extends along the slot 5, inserted in the slot 5. The integrated circuit board 3 extends transversely to the fin-line converter 2. The fin-line converter 2 converts the propagation mode from a waveguide mode in the primary radiator to a microstrip transmission line mode in the microstrip transmission line 4.

Figure 4:
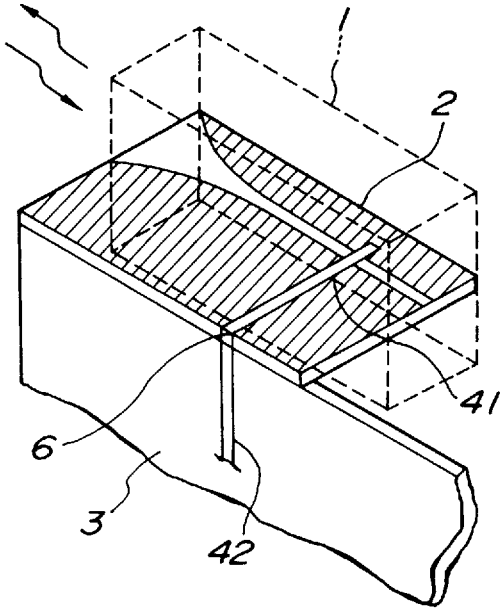
FIG. 4 perspective view of a primary radiator with a fin-line converter having a strip transmission line connected through boards to a strip transmission line of an integrated circuit board of transmitter and receiver circuits.

FIG. 4 illustrates a horn-type primary radiator 1 combined with a fin-line converter 2 positioned therein for converting the propagation mode of electromagnetic waves from a waveguide mode to a microstrip transmission line mode. The fin-line converter 2 has a microstrip transmission line 41 projecting out of the primary radiator 1. An integrated circuit board 3 of transmitter and receiver circuits is disposed outside of the primary radiator 1, and has a microstrip transmission line 42 that is connected to the microstrip transmission line 41 through beads 6. The fin-line converter 2 converts the propagation mode from a waveguide mode in the primary radiator to a microstrip transmission line mode in the microstrip transmission line 4.

As shown in FIGS. 1, 2, and 4, using the fin-line converter 2, the integrated circuit board 3 of transmitter and receiver circuits may be positioned at any angle with respect to the primary radiator 1. Therefore, when the primary radiator 1 is integrally formed in a case of the integrated circuit board 3 of transmitter and receiver circuits and they are connected to each other by the microstrip transmission line or lines, the primary radiator 1 and the integrated circuit board 3 may be assembled in a desired structure in the case.

Figure 5:
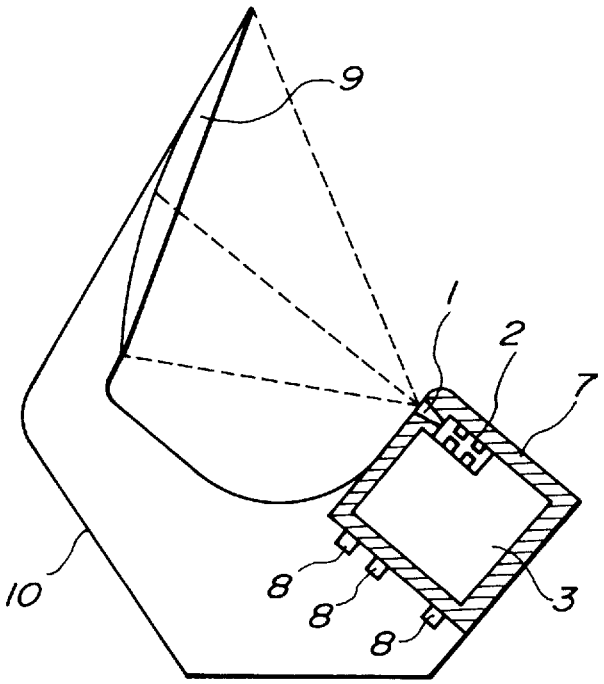
FIG. 5 is a side elevational view, partly in cross section, of a multichannel antenna device according to an embodiment of the present invention.
Figure 6:
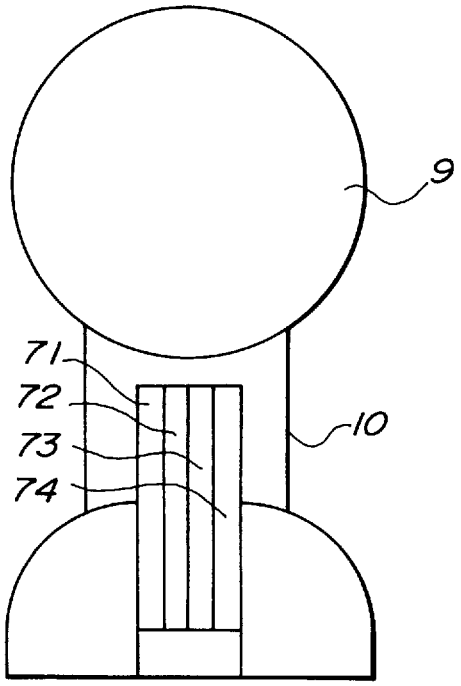
FIG. 6 is a front elevational view of the antenna device shown in FIG. 5.
Figure 7:
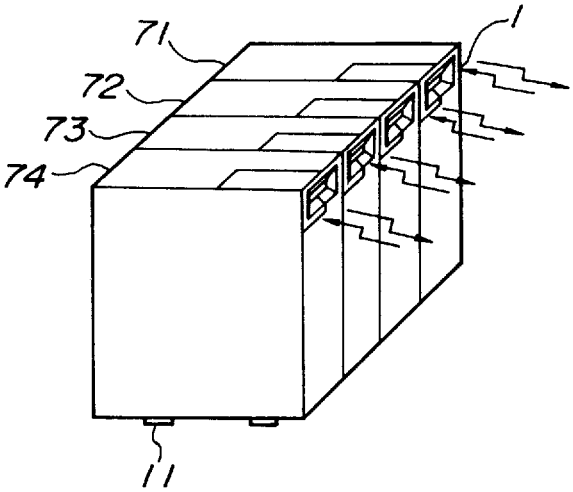
FIG. 7 is a perspective view of a case, integral with primary radiators, of integrated circuit boards of transmitter and receiver circuits of the antenna device shown in FIG. 5.

FIGS. 5 through 7 show a multichannel antenna device according to an embodiment of the present invention.

As shown in FIG. 5, the antenna device has a case 7 accommodating integrated circuit boards 3 of transmitter and receiver circuits. The case 7 has an array of horn-type primary radiators 1 integrally formed therein which incorporate respective fin-line converters 2. The antenna device also has external connection terminals 8 on the case 3, a reflector 9 spaced from the primary radiators 1, and a holder 10 on which the case 7 and the reflector 9 are supported in spaced-apart relationship to each other. The reflector 9 comprises an offset multibeam reflector for increasing the gain of a radiated beam.

As shown in FIGS. 6 and 7, the case 7 comprises an array of four vertical case members 71, 72, 73, 74 arranged side by side each integrally combined with the primary radiator 1 and the integrated circuit board 3 of transmitter and receiver circuits. Therefore, the antenna device is of a 4-channel arrangement. In this embodiment, the cases 71–74 housing the integrated circuit boards 3 and integral with the respective 0-channel primary radiators 1 serve as respective radar modules. The radar modules and the respective primary radiators 1 are held in line with the reflector 9, i.e., fixedly positioned at the focal point of the offset multibeam reflector 9 for preventing an antenna radiation pattern from being varied by any displacement, which would otherwise occur, of the radar modules from the focal point.

Figure 8:
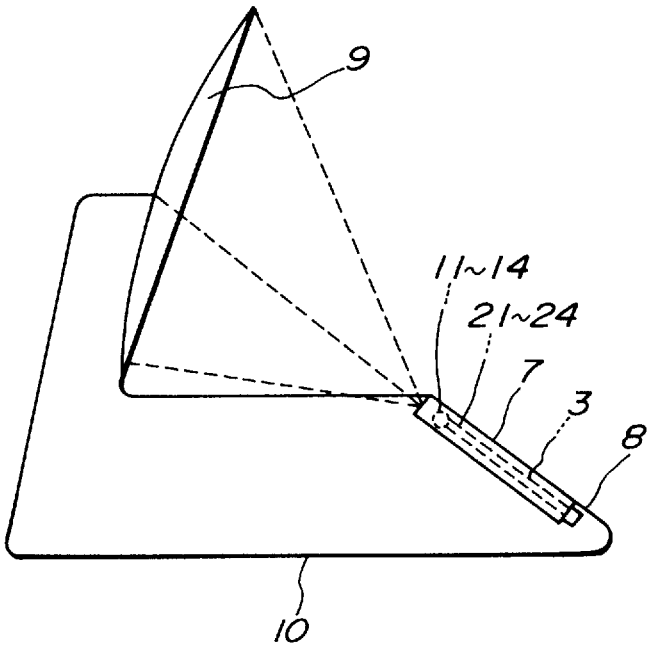
FIG. 8 is a side elevational view of a multi-channel antenna device according to another embodiment of the present invention.
Figure 9:
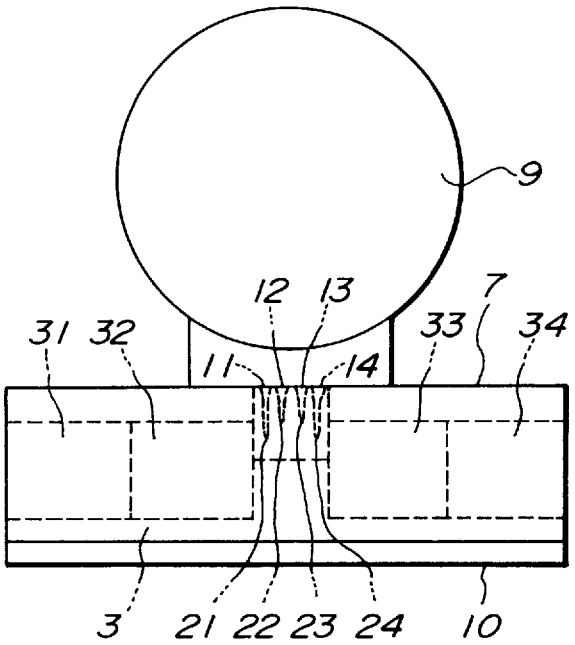
FIG. 9 is a front elevational view of the antenna device shown in FIG. 8.
Figure 10:
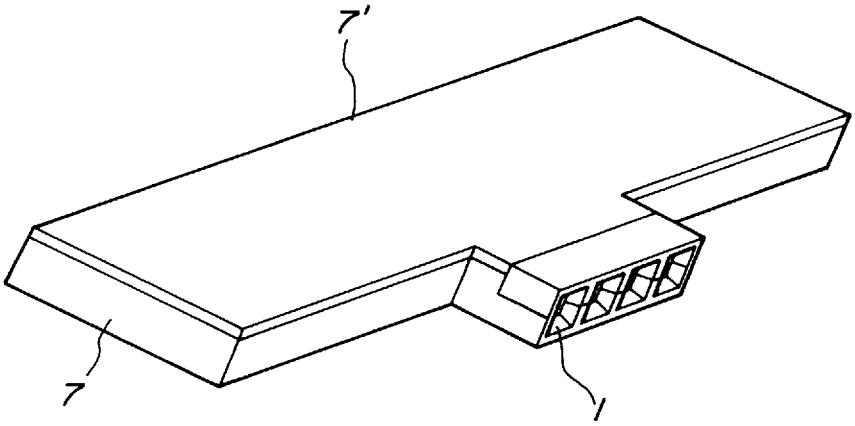
FIG. 10 is a perspective view of a case, integral with primary radiators, of integrated circuit boards of transmitter and receiver circuits of the antenna device shown in FIG. 8.

FIGS. 8 through 10 show a multichannel antenna device according to another embodiment of the present invention.

As shown in FIGS. 8 and 9, the antenna device has a single integrated circuit board 3 of 4-channel transmitter and receiver circuits 31, 32, 33, 34, and a single case 7 housing the integrated circuit board 3 in a plane. The case 7 has a 4-channel array of horn-type primary radiators 11, 12, 13, 14 (see also FIG. 10) integrally formed therein and arranged side by side in the central position on one side of the case 7. The primary radiators 11–14 project laterally from the side of the case 7 with their projecting ends lying flush with each other. The case 7 has a cover 7 which is closed after the integrated circuit board 3 has been assembled in the case 7. The primary radiators 11, 12, 13, 14 are combined with respective fin-line converters 21, 22, 23, 34.

The antenna device also has external connection terminals 8 connected to the integrated circuit board 3, an offset reflector 9, and a holder 10 which supports the reflector 9 in spaced-apart relationship to the primary radiators 11–14.

Since the single integrated circuit board 3 is placed in single case 7, the antenna device is simple in structure and can easily be assembled.

In FIGS. 8 through 10, the primary radiators 11–14 are arranged with their H-plane walls lying at their boundaries. The primary radiators 11–14 thus arranged are positioned more closely to the focal point of the off-set reflector 9 than the primary radiators 1 shown FIG. 7 which are arranged with their E-plane walls lying at their boundaries. Therefore, the efficiency of beams radiated by the primary radiators 11, 14 of the 1st and 4th channels, particularly, is relatively high.

Figure 11:
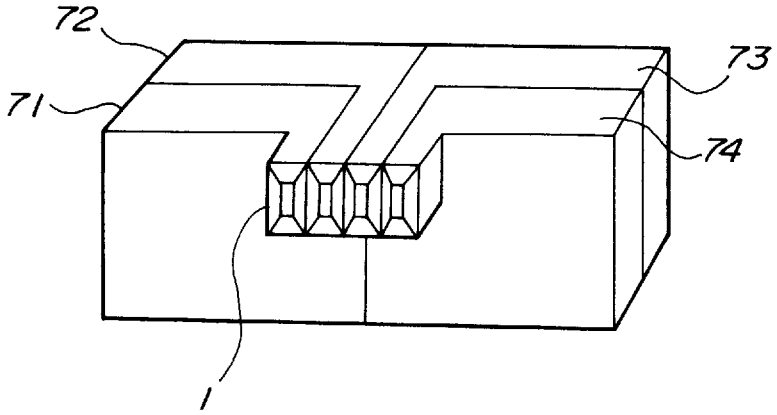
FIG. 11 is a perspective view of a case, integral with multichannel primary radiators, of integrated circuit boards of transmitter and receiver circuits according to still another embodiment of the present invention.

FIG. 11 shows a case, integral with multichannel primary radiators, of integrated circuit boards of transmitter and receiver circuits according to still another embodiment of the present invention. The case comprises an array of case members 71, 72, 73, 74 having respective integral horn-type primary radiators 1. The case members 71, 72 are superposed one on each other, and the case members 73, 74 are also superposed one on each other. The primary radiators 1 extending from the respective case members 71–74 are positioned centrally on the case and project laterally from one side of the case, with their projecting ends lying flush with each other.

Figure 12:
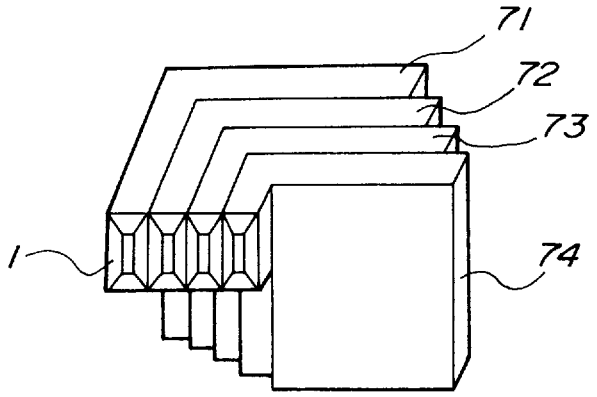
FIG. 12 is a perspective view of a case, integral with multichannel primary radiators, of integrated circuit boards of transmitter and receiver circuits according to a further embodiment of the present invention.

FIG. 12 shows a case, integral with multichannel primary radiators, of integrated circuit boards of transmitter and receiver circuits according to a further embodiment of the present invention. The cage comprises an array of case members 71, 72, 73, 74 having respective integral horn-type primary radiators 1. The case members 71–74 are superposed one on each other. The primary radiators 1 extending from the respective case members 71–74 are positioned at one end of the case and project laterally from one side of the case, with their projecting ends lying flush with each other.

In the embodiments shown in FIGS. 11 and 12, the width of the antenna device is relatively small as the case members 71–74 are of a superposed structure. As the primary radiators 1 are closely positioned, the efficiency of beams radiated from the primary radiators at the ends of their array is relatively high. Inasmuch as integrated circuit boards in the respective channels are separate from each other, the channels can more easily be inspected and serviced than the arrangement shown in FIG. 10, allowing only those channels which have poor characteristics to be replaced.

If primary radiators capable of both transmitting and receiving radio waves are employed, it is necessary to employ circulators in the respective radar modules. However, small-size circulators that can be mounted on presently available microwave integrated circuit boards cannot achieve desired isolation between transmitted and received signals. Circulators with sufficient isolation characteristics cannot actually be mounted on microwave integrated circuit boards. Therefore, antenna devices with such circulators with sufficient isolation characteristics are considerably large in size and expensive to manufacture.

Figure 13:
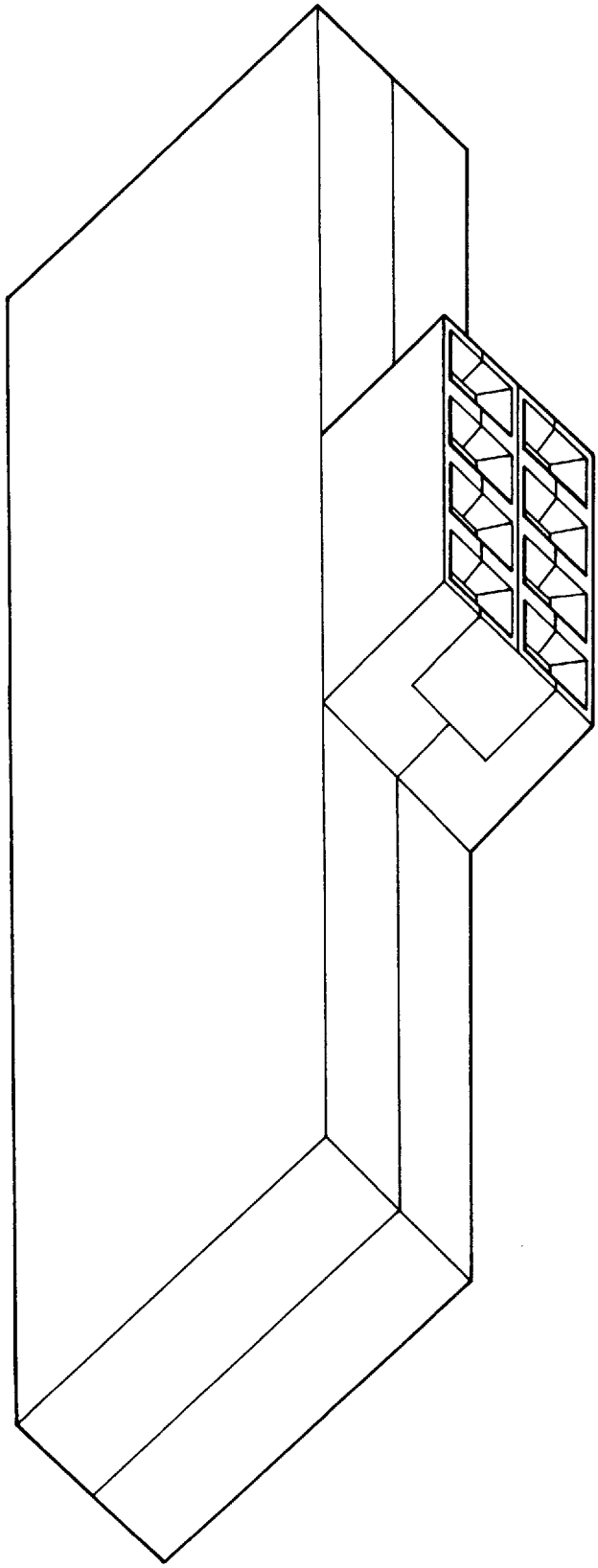
FIG. 13 is a perspective view of a cage, integral with primary radiators, of integrated circuit boards of transmitter and receiver circuits according to a still further embodiment of the present invention.
Figure 14:
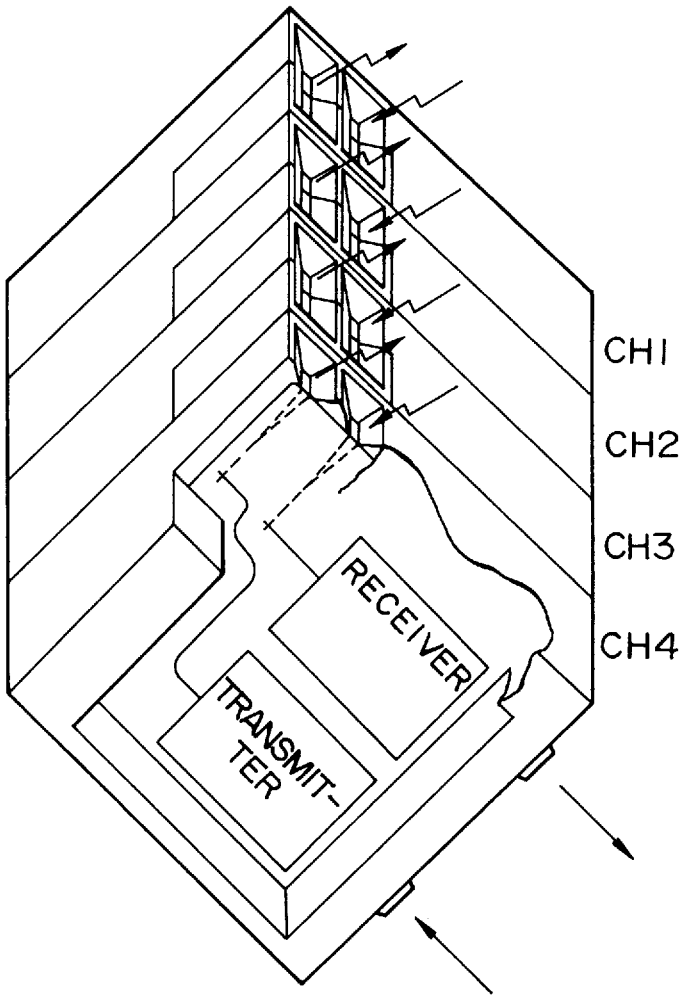
FIG. 14 is a perspective view of a case, integral with multichannel primary radiators, of integrated circuit boards of transmitter and receiver circuits according to a yet further embodiment of the present invention.

FIGS. 13 and 14 show respective cases, integral with primary radiators, of integrated circuit boards of transmitter and receiver circuits according to other embodiments of the present invention.

In FIG. 13, upper and lower arrays of primary radiators respectively for transmitting and receiving radio waves are integrally formed in and disposed centrally on one side of a single case, the primary radiators projecting laterally from the case.

In FIG. 14, upper and lower arrays of primary radiators respectively for transmitting and receiving radio waves are integrally formed in multichannel case members of a case, the primary radiators opening laterally from the case members.

With the primary radiators shown in FIGS. 13 and 14, since no small-size circulators for being mounted on integrated circuits are employed, the antenna devices are free of the problem that noise due to poor isolation would enter the receiver circuits, making it impossible to detect objects in a close range.

Figure 15:
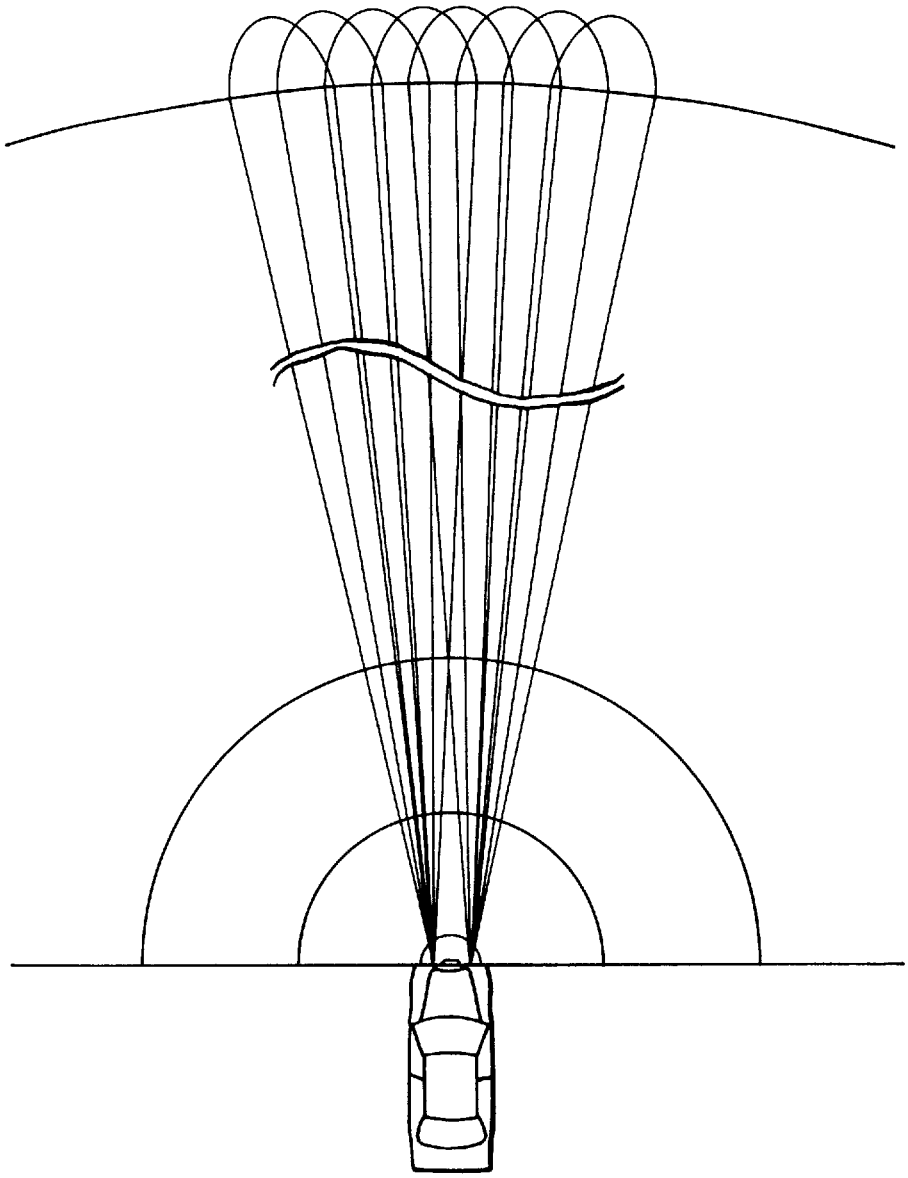
FIG. 15 is a diagram showing a radiation pattern of two offset multibeam antenna devices with 4-channel radar modules, the antenna devices being mounted on the front end of an automobile.

FIG. 15 shows a radiation pattern of two offset multibeam antenna devices with 4-channel integral radar modules according to the present invention, the antenna devices being mounted on the front end of an automobile. While radio-wave beams are being radiated from the primary radiators, the eight channels are successively switched in a time-division multiplexing fashion to search an area in front of the automobile.

The offset multibeam antenna device with integral radio modules according to the present invention may be employed to construct a small-size, lightweight radar system. Since the primary radiators, the reflector, and the radar modules are integrally combined with each other, the primary radiators are prevented from being displaced out of the focal point of the reflector. Therefore, the antenna device can produce a stable antenna beam radiation pattern.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed:

1. A light-weight multi-beam antenna device comprising:

a plurality of radar modules capable of transmitting and receiving electromagnetic waves, each radar module comprising an integrated circuit board having formed thereon a transmitter circuit, a receiver circuit and microstrip transmission lines connected to the transmitter and receiver circuits;

a plurality of primary radiators formed integrally with respective ones of said plurality of transmitter and receiver circuits, each primary radiator being coupled to a respective transmitter or receiver circuit of a radar module;

a plurality of fin-line converters formed integrally with and coupled between respective ones of said primary radiators and said transmitter and receiver circuits for converting a propagation mode of electromagnetic waves from a waveguide mode in said respective primary radiators to a microstrip transmission line mode in said respective microstrip transmission lines coupled to said transmitter and receiver circuits; and circuitry connected to said transmitter and receiver circuits for enabling operation of said radar modules in a time division multiplexed manner.

2. The light-weight multi-beam antenna device of claim 1 further comprising an offset beam reflector, said offset beam reflector being formed integrally with a holder of said radar modules.

3. A light-weight multi-beam antenna device comprising:

a plurality of radar modules capable of transmitting and receiving electromagnetic waves, each radar module comprising a first integrated circuit board having a transmitter circuit, receiver circuit, circulator and microstrip transmission line formed thereon, said microstrip transmission line being connected to said transmitter circuit, said receiver circuit and said circulator, a second integrated circuit board affixed to said first integrated circuit board and having formed thereon a primary radiator and a fin-line converter, said fin-line converter providing an electrical connection between said primary radiator and said microstrip transmission line of said first integrated circuit board; and circuitry connected to said transmitter and receiver circuits for enabling operation of said radar modules in a time division multiplexed fashion.

4. The light-weight multi-beam antenna device of claim 1 further comprising an offset beam reflector, said offset beam reflector being formed integrally with a holder of said radar modules.

5. A light-weight, multi-beam antenna comprising:

at least four radar modules, each being housed within a casing having a generally parallel piped structure, and each comprising a first integrated circuit board having a transmitter circuit, receiver circuit, circulator and microstrip transmission line formed thereon, said microstrip transmission line being connected to said transmitter circuit, said receiver circuit and said circulator, and a second integrated circuit board affixed to said first integrated circuit board and having formed thereon a primary radiator and a fin-line converter, said fin-line converter providing an electrical connection between said primary radiator and said microstrip transmission line of said first integrated circuit board; and an offset reflector attached to said casings of said radar modules;

said casings of said radar modules being arranged in a generally side-by-side configuration such that said primary radiators of said radar modules are arranged within a linear array, are positioned within a general area of a focal point of said offset reflector, and may be used in conjunction with said offset reflector to effect multi-channel scanning of a horizontal beam.

6. A light-weight, multi-beam antenna comprising:

at least four radar modules, each being housed within a casing having a generally parallel piped structure, and each comprising an integrated circuit board having formed thereon a transmitter circuit, a receiver circuit and microstrip transmission lines connected to the transmitter and receiver circuits;

a plurality of primary radiators formed integrally with respective ones of said plurality of transmitter and receiver circuits, each primary radiator being coupled to a respective transmitter or receiver circuit of a radar module; and a plurality of fin-line converters formed integrally with and coupled between respective ones of said primary radiators and said transmitter and receiver circuits for converting a propagation mode of electromagnetic waves from a waveguide mode in said respective primary radiators to a microstrip transmission line mode in said respective microstrip transmission lines coupled to said transmitter and receiver circuits; and an offset reflector attached to said casings of said radar modules;

said casings of said radar modules being arranged in a generally side-by-side configuration such that said primary radiators of said radar modules are arranged within first and second linear arrays, are positioned within a general area of a focal point of said offset reflector, and may be used in conjunction with said offset reflector to effect multi-channel scanning of a horizontal beam.

* * * * *